US007801453B2

(12) United States Patent
Golding et al.

(10) Patent No.: US 7,801,453 B2
(45) Date of Patent: Sep. 21, 2010

(54) ADAPTIVE TONER GAS GAUGE

(75) Inventors: Paul S. Golding, Hertford (GB); Christopher J. Moloney, Hertfordshire (GB); Stuart J. Handley, Welwyn Garden (GB)

(73) Assignee: Xerox Corporation, Norwalk, CT (US)

( * ) Notice: Subject to any disclaimer, the term of this patent is extended or adjusted under 35 U.S.C. 154(b) by 779 days.

(21) Appl. No.: 11/737,443

(22) Filed: Apr. 19, 2007

(65) Prior Publication Data

US 2008/0232829 A1 Sep. 25, 2008

Related U.S. Application Data

(63) Continuation-in-part of application No. 11/690,524, filed on Mar. 23, 2007, now abandoned.

(51) Int. Cl.
*G03G 15/08* (2006.01)

(52) U.S. Cl. ..... 399/27; 399/81

(58) Field of Classification Search ..... 399/24, 399/27, 29, 81

See application file for complete search history.

(56) References Cited

U.S. PATENT DOCUMENTS

| | | | | |
|---|---|---|---|---|
| 5,289,955 | A | 3/1994 | Sulenski | |
| 5,802,420 | A | 9/1998 | Garr et al. | |
| 5,839,022 | A | 11/1998 | Wang et al. | |
| 5,995,774 | A | 11/1999 | Applegate et al. | |
| 6,408,143 | B2 * | 6/2002 | Sakurai et al. | 399/27 |
| 6,810,218 | B1 | 10/2004 | Wong et al. | |
| 7,061,391 | B2 * | 6/2006 | Hopper et al. | 399/24 |

* cited by examiner

*Primary Examiner*—William J Royer
(74) *Attorney, Agent, or Firm*—Oliff & Berridge PLC

(57) ABSTRACT

In accordance with certain aspects, an adaptive system and method are implemented to estimate the level of a consumable such as toner on a gauge that accommodates machine-to-machine variances, individual machine degradation over time, and otherwise correct over time for various inaccuracies by applying an error compensation that can be used in subsequent replenisher computations. Over the lifetime of an imaging machine, such as a copier or printer device, these error compensations can increase the accuracy of the particular machine, to accommodate various deviations from nominal constraint assumptions as a result of differences in one or more operating constraints.

20 Claims, 6 Drawing Sheets

ADAPTIVE TONER GAS GAUGE

CROSS-REFERENCE TO RELATED APPLICATIONS

This application is a Continuation-in-Part of application Ser. No. 11/690,524 filed Mar. 23, 2007 now abandoned.

BACKGROUND

Methods and systems for adaptive estimation of remaining consumables level, such as toner, in an imaging machine are provided.

Various imaging machines include a "gas gauge" or other indicator for visualizing remaining levels of consumables, such as toner. Examples are found in U.S. Pat. No. 6,810,218 to Wong et al., U.S. Pat. No. 5,802,420 to Garr et al., and U.S. Pat. No. 5,995,774 to Applegate et al., the disclosures of which are incorporated herein by reference in their entireties. Other examples of "gas gauge" indicators can be found in various commercially available products, such as Xerox's Phaser™ 560 and 5500 Model Printers. These use either an actual measurement of toner usage or an approximation based upon empirical data.

SUMMARY

A toner "gas gauge" predicts the amount of toner or other consumables remaining in a cartridge or container, based on one or more distinguishable usage indicators and one or more calibration constants. A distinguishable usage indicator may include, for example, one or more indirect indicators that can be used as a reference to approximate a toner dispense rate, such as toner dispense motor pulse counts. These can be used with a predefined formula and one or more calibration constants to approximate remaining toner levels without direct measurement. Exemplary calibration constants, typically determined theoretically or empirically through testing, may include toner dispense rate, replenisher mass, motor start up and run on times, and the like. Such calibration constants are typically selected to indicate operation of a "standard" device and are statically set.

However, machine-to-machine deviations from nominal dispense motor performance, machine voltage supply differences, frictional forces, start replenisher mass variations, certain customer usage characteristics, and other changing operating criteria, such as individual machine degradation over time, can lead to inaccuracies in the estimated residual amount of consumables remaining (often expressed in percent remaining or days remaining) on the toner gauge. Because of these inaccuracies, the level of consumables remaining may give a false indication of remaining level. This may cause replacement prior to actual need, or worse, running out of consumables when the indicator gauge indicates that quantities should remain. The latter problem is particularly problematic in that there is usually a delay or lag time, often up to several days, in ordering and obtaining replacement cartridges. This results in wasteful downtime and loss of productivity for the imaging machine. Accordingly, a system with static calibration constants cannot adapt to changing operational constraints or always account for machine-to-machine variations.

In accordance with certain aspects, an adaptive system and method are implemented that will accommodate machine-to-machine variances, individual machine degradation over time, and otherwise correct over time for various inaccuracies by applying an error compensation that can be used in subsequent replenisher computations. Over the lifetime of the imaging machine, such as a copier or printer device, these error compensations can increase the accuracy of the particular machine, to accommodate various deviations from nominal constraint assumptions as a result of differences in one or more operating constraints.

In accordance with a first aspect, a method for adaptive display of a consumables gauge on an imaging machine, includes: initializing calibration constants upon installation of a new consumable product in the machine; obtaining at least one distinguishable usage indicator serving as a reference to approximate consumable dispense rate of the consumable product; estimating the level of the gauge based on a total accumulation of the at least one distinguishable usage indicator and at least one predefined calibration constant; displaying the estimated consumable level on the gauge; obtaining a final cumulative distinguishable usage indicator value at time of replacement of the consumable product; and calculating a correction factor, r, to be used in subsequent estimation of consumable level on the gauge based on the final cumulative distinguishing usage indicator value.

In accordance with a further aspect, a method of adapting an estimation of a consumables level gauge for an imaging machine to reflect usage during a prior consumables cycle, includes: retrieving a final cumulative usage indicator value at the time of replacement of a consumable product replacement; passing the final cumulative usage indicator value through a bounded threshold that discounts an atypical cumulative value that falls outside of a predefined bounded range; and calculating a correction factor r to be used in subsequent consumables level gauge estimation that is based on the final cumulative usage indication.

In accordance with yet further aspects, an adaptive consumables level gauge for an imaging machine, includes: a display that visualizes remaining levels of consumables; a consumables gauge circuit that receives at least one distinguishable usage indicator serving as a reference to approximate consumable dispense amounts and estimates the level of the gauge based on the at least one distinguishable usage indicator and at least one predefined calibration constant; and a feedback control circuit that obtains a correction factor based on a cumulative usage indicator value at the time of actual consumables replacement to be used in subsequent determination of consumables level gauge estimates.

In various exemplary embodiments, bounding limits may be defined to set expected deviations limits for one or more operating constraint variables. If the bounding limits are exceeded, the values obtained for this particular replenisher life cycle are deemed atypical and are discounted or ignored for error compensation.

In accordance with certain exemplary embodiments, one or more operating constraints monitored may be filtered using a low-pass filter to minimize effects of statistical (random) variations. One such operating constraint may be dispense time.

In accordance with various embodiments, it may be desirable to provide non-linear filtering. For example, one that responds more rapidly when a cumulative dispense time is less than its previous value from prior replenisher life cycles and responds less rapidly when the cumulative dispense time is greater than its previous value from prior replenisher life cycles. One benefit of such non-linear filtering is that it is more desirable to receive an early "reorder" message warning from the system, than a late message. That is, if the reorder message is received late, there is a likelihood that consumables will deplete entirely and the machine will encounter significant downtime awaiting a replacement order. However, if the "reorder" message is consistently early, further customer dissatisfaction may result as trust in the gauge is compromised.

In accordance with various embodiments, low-pass filtering of the correction may be used to more slowly adapt correction to a more accurate assessment of consumable level, rather than fluctuating in an alternating manner between over and under-estimation.

BRIEF DESCRIPTION OF THE DRAWINGS

Exemplary embodiments will be described with reference to the drawings, wherein.

DETAILED DESCRIPTION OF EMBODIMENTS

Figure 1:
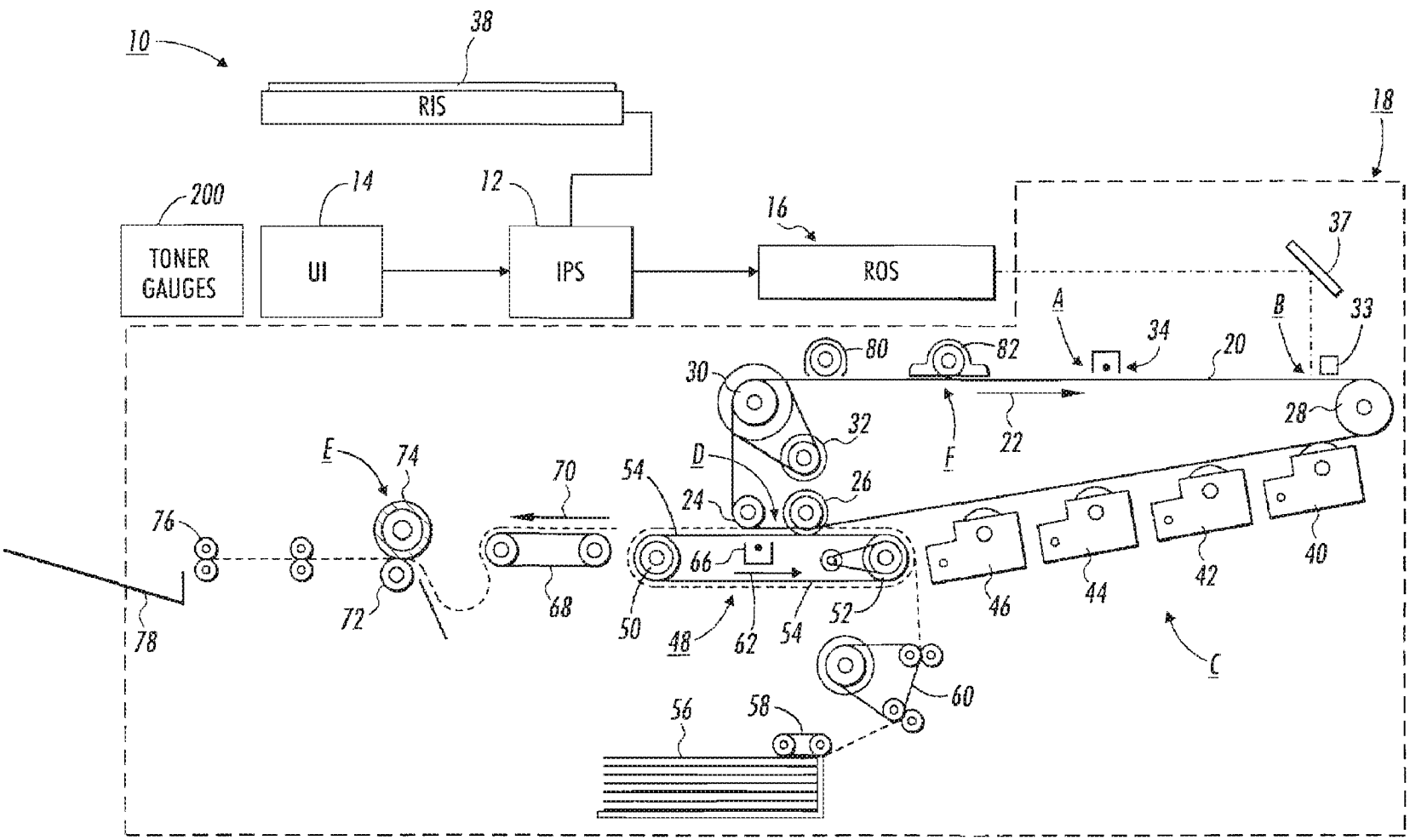
FIG. 1 is a schematic elevational view of an exemplary imaging machine, in this case a multi-color electrophotographic printing machine, that includes at least one toner gauge.

A schematic elevational view of an exemplary imaging machine, such as an electrophotographic printing machine, is shown in FIG. 1. It will become evident from the following discussion that aspects of the disclosure are equally well-suited for use in a wide variety of imaging systems having one or more consumables to be monitored, such as copiers with single component or multi-component toners, facsimile devices, laser printers, solid ink printers, ink jet printers, and the like, and is not limited in its application to the particular system shown herein or the particular consumables being monitored. Instead, aspects of the disclosure relate generally to adaptive systems and methods of consumables level estimation for improved gauge accuracy.

The basic reprographic process used in an electrophotographic imaging machine generally involves an initial step of charging a photoconductive member to a substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer material including toner particles adhering triboelectrically to carrier granules into contact with the latent image. The toner particles are attracted away from the carrier granules to the latent image, forming a toner image on the photoconductive member which is subsequently transferred to a copy sheet. The copy sheet having the toner image thereon is then advanced to a fusing station for permanently affixing the toner image to the copy sheet in image configuration.

In the process of attracting toner particles to electrostatic images for toning, toner particles are depleted from the developer mixture, requiring replenishment to avoid a gradual reduction in density of the toner images. Toner replenishment is accomplished by several different types of apparatus. In one type, a given amount of toner is added to the mixture after a given number of copies is made. Proper operation of the device requires an adequate supply of toner. To ensure that such a supply exists, a toner "gas gauge" display 200 (FIG. 3) can be provided to allow the user to monitor the toner level so that replacement can be timely performed.

To initiate the copying process, a multicolor original document 38 is positioned on a raster input scanner (RIS), indicated generally by the reference numeral 10. The RIS 10 typically contains document illumination lamps, optics, a mechanical scanning drive, and a charge coupled device (CCD array) for capturing the entire image from original document 38. The RIS 10 converts the image to a series of raster scan lines and measures a set of primary color densities at each point of the original document 38. This information is transmitted as an electrical signal to an image processing system (IPS) 12, which converts the set of density signals to a set of colorimetric coordinates. The IPS contains control electronics for preparing and managing the image data flow to a raster output scanner (ROS), indicated generally by the reference numeral 16.

A user interface (UI), indicated generally by the reference numeral 14, is provided for communicating with IPS 12. UI 14 enables an operator to control the various operator adjustable functions, by the operator actuating the appropriate input keys of UI 14 to adjust the parameters of the copy. UI 14 may be a touch screen, or any other suitable device for providing an operator interface with the system. The output signal from UI 14 is transmitted to IPS 12, which then transmits signals corresponding to the desired image to ROS 16.

ROS 16 typically includes a laser with rotating polygon mirror blocks. The ROS 16 illuminates, via mirror 37, a charged portion of a photoconductive belt 20 of a printer or marking engine, indicated generally by the reference numeral 18. The ROS 16 exposes the photoconductive belt 20 to record a set of three subtractive primary latent images thereon corresponding to the signals transmitted from IPS 12. One latent image is to be developed with cyan developer material, another latent image is to be developed with magenta developer material, and the third latent image is to be developed with yellow developer material. These developed images are subsequently transferred to a copy sheet in superimposed registration with one another to form a multicolored image on the copy sheet, which is then fused thereto to form a color copy.

With continued reference to FIG. 1, marking engine 18 includes photoconductive belt 20 entrained about transfer rollers 24 and 26, tensioning roller 28, and drive roller 30. Drive roller 30 is rotated by a motor or other suitable mechanism coupled to the drive roller 30 by suitable means such as a belt drive 32. As drive roller 30 rotates, it advances photoconductive belt 20 in the direction of arrow 22 to sequentially advance successive portions of the photoconductive belt 20 through the various processing stations disposed about the path of movement thereof.

Initially, a portion of photoconductive belt 20 passes through a charging station, indicated generally by the reference letter A. At charging station A, a corona generating device 34 or other charging device generates a charge voltage to charge photoconductive belt 20 to a relatively high, substantially uniform voltage potential.

Next, the charged photoconductive belt 20 is rotated to an exposure station, indicated generally by the reference letter B. Exposure station B receives a modulated light beam corresponding to information derived by RIS 10 having a multicolored original document 38 positioned thereat. The modulated light beam impinges on the surface of photoconductive belt 20, selectively illuminating the charged surface of photoconductive belt 20 to form an electrostatic latent image thereon. The photoconductive belt 20 is exposed three times to record three latent images representing each color.

After the electrostatic latent images have been recorded on photoconductive belt 20, the belt is advanced toward a development station, indicated generally by the reference letter C. However, before reaching the development station C, the photoconductive belt 20 passes near a voltage monitor, such as an electrostatic voltmeter 33 of any suitable type known in the art.

The development station C includes one or more individual developer units 40, 42, 44 and 46. The developer units are of a type generally referred to in the art as magnetic brush development units. Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive belt 20.

Developer units 40, 42, and 44, respectively, apply toner particles of a specific color corresponding to the complement of the specific color separated electrostatic latent image recorded on the photoconductive belt 20. Each of the toner particle colors is adapted to absorb light within a preselected spectral region of the electromagnetic wave spectrum. For example, an electrostatic latent image formed by discharging the portions of charge on the photoconductive belt 20 corresponding to the green regions of the original document 38 will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document.

After development, the toner image is moved to a transfer station, indicated generally by the reference letter D. Transfer station D includes a transfer zone, defining the position at which the toner image is transferred to a sheet of support material, which may be a sheet of plain paper or any other suitable support substrate. A sheet transport apparatus, indicated generally by the reference numeral 48, moves the sheet into contact with photoconductive belt 20. Sheet transport apparatus 48 has a belt 54 entrained about a pair of substantially cylindrical rollers 50 and 52. A friction retard feeder 58 advances the uppermost sheet from stack 56 onto a pretransfer transport 60 for advancing a sheet to sheet transport apparatus 48 in synchronism with the movement thereof so that the leading edge of the sheet arrives at a preselected position, i.e. a loading zone. The sheet is received by the sheet transport apparatus 48 for movement therewith in a recirculating path. As belt 54 of transport 48 moves in the direction of arrow 62, the sheet is moved into contact with the photoconductive belt 20, in synchronism with the toner image developed thereon.

In the transfer zone, a corona generating device 66 charges the sheet to the proper magnitude and polarity for attracting the toner image from photoconductive belt 20 thereto. The sheet remains secured to a sheet gripper so as to move in a recirculating path for three cycles. In this manner, three different color toner images are transferred to the sheet in superimposed registration with one another. Each of the electrostatic latent images recorded on the photoconductive belt 20 is developed with the appropriately colored toner and transferred, in superimposed registration with one another, to the sheet for forming the multi-color copy of the colored original document 38. One skilled in the art will appreciate that the sheet may move in a recirculating path for four cycles when undercolor black removal is used.

After the last transfer operation, the sheet transport apparatus 48 directs the sheet to a vacuum conveyor, indicated generally by the reference numeral 68. Vacuum conveyor 68 transports the sheet, in the direction of arrow 70, to a fusing station, indicated generally by the reference letter E, where the transferred toner image is permanently fused to the sheet. The fusing station E includes a heated fuser roll 74 and a pressure roll 72. The sheet passes through a nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of photoconductive belt 20, as indicated by arrow 22, is a cleaning station, indicated generally by the reference letter F. A lamp 80 illuminates the surface of photoconductive belt 20 to remove any residual charge remaining thereon. Thereafter, a rotatably mounted fibrous brush 82 is positioned in the cleaning station F and maintained in contact with photoconductive belt 20 to remove residual toner particles remaining from the transfer operation prior to the start of the next successive imaging cycle.

Figure 2:
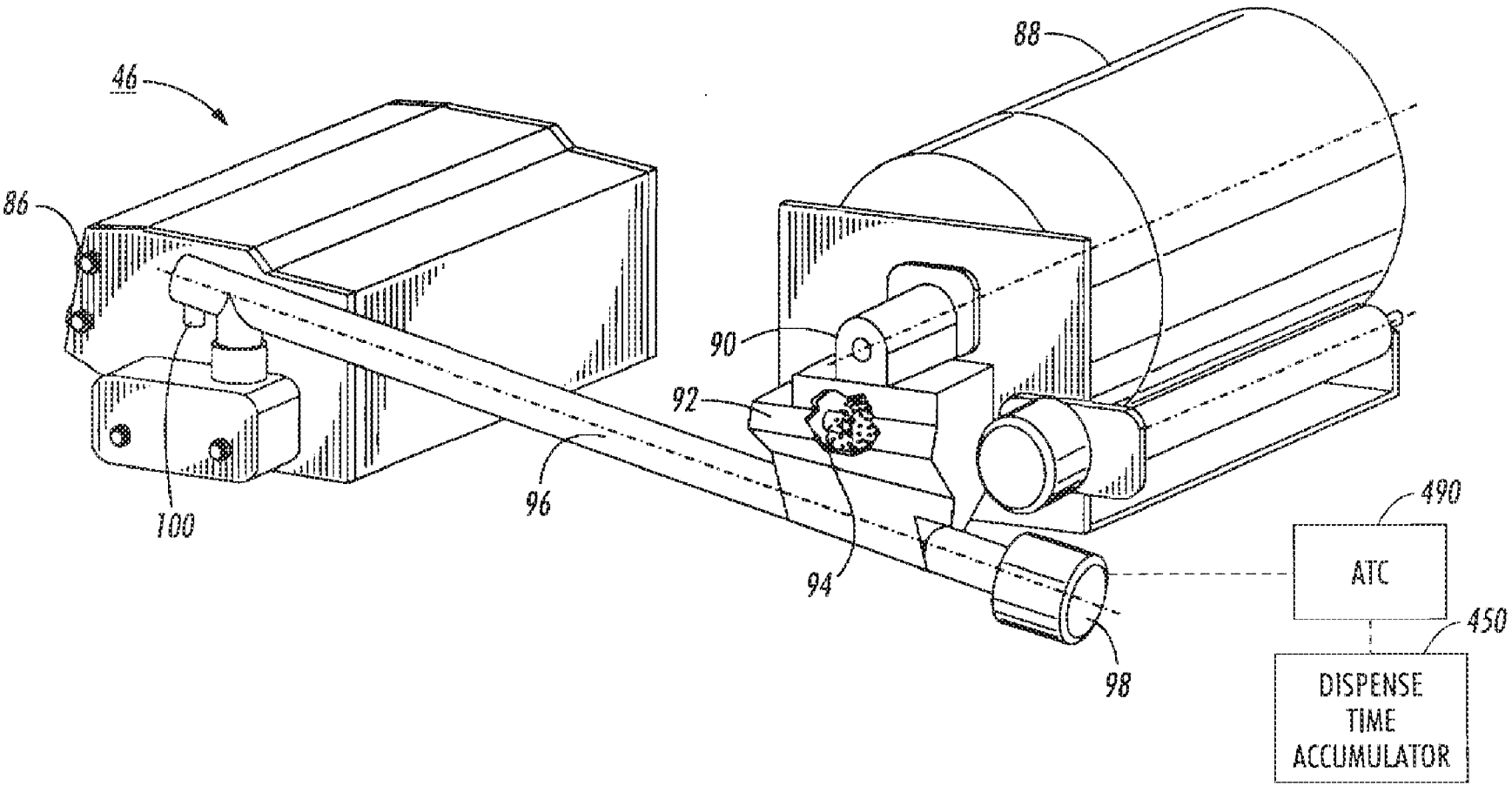
FIG. 2 illustrates an exemplary developer unit including a toner dispensing device.

FIG. 2 shows in greater detail one of the developer units such as 46 illustrated in FIG. 1. The developer unit 46 includes a developer 86 such as a magnetic brush developer for applying toner to a latent image. The magnetic brush developer is generally provided in a developer housing and the rear of the housing usually forms a sump containing a supply of developing material. A passive crossmixer in the sump area may be provided to mix the developing material. It should be noted that magnetic brush development is only one example of a development system. The disclosure is, however, not limited by the type of development.

As will be understood by those skilled in the art, the electrostatically attractable developing material commonly used in magnetic brush developing apparatus comprises a pigmented resinous toner powder (toner) and larger granular beads referred to as carrier. To provide the necessary magnetic properties, the carrier is composed of a magnetizable material such as steel. By virtue of the magnetic field established by the magnetic brush developer, a blanket of developing material is formed along the surface of the magnetic brush developer adjacent the photoconductive belt 20. Toner is attracted to the electrostatic latent image from the carrier beads to produce a visible powder image on the photoconductive belt 20.

To replenish the supply of toner, developer 86 is connected to a replenisher mechanism including a toner bottle 88 providing a source of toner particles, a dispensing mechanism, such as extracting auger 90, for dispensing toner particles from toner bottle 88, and a hopper 92 receiving toner particles from the dispensing mechanism. Hopper 92 preferably is connected to a delivery auger 96, which can be activated by a suitable drive, such as rotation of drive motor 98, to convey toner particles from hopper 92 for distribution to developer 86. A suitable toner concentration sensor illustrated at 100 within the developer housing may be provided to signal to the system control indicative of the toner concentration or ratio of toner and carrier in developer 86. Toner concentration sensor 100 may be a magnetic permeability sensor for distinguishing the magnetic characteristics of toner and carrier particles within developer 86. One such sensor is the well known magnetic permeability Packer sensor.

Figure 3:
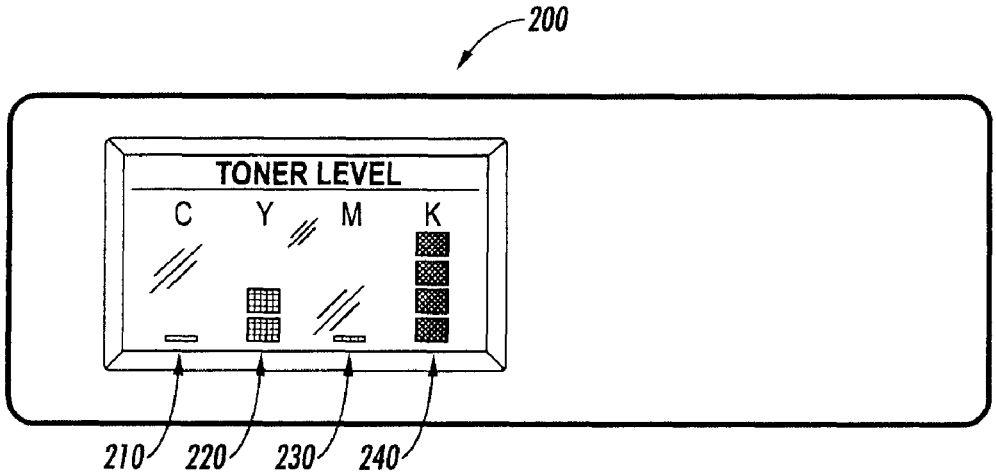
FIG. 3 illustrates an exemplary toner gas gauge indicator.

A suitable low toner level sensor shown at 94 may be provided to signal to the system control that toner bottle 88 must be re-filled or replaced. While level sensor 94 may be provided to indicate an empty toner condition, the exemplary imaging machine further includes at least one toner "gas gauge" 200 to display an estimation of remaining toner level in the replenisher toner bottle 88. When used in a multi-color printing machine having multiple colored toners, such as CYMK, a separate toner "gas gauge" 200 may be provided for each color. For example, as shown in FIG. 3, the imaging machine itself may include a "gas gauge" 200 having a separate toner gauge indicator 210, 220, 230, 240 for each color (CYMK). Alternatively, the gauge 200 may be remotely located on a PC display monitor.

Gauge 200 can take various forms in order to provide an indication of remaining toner quantities. In the example shown, gauge 200 may be a graphic indicating the relative level of toner, in which a taller graphic represents a higher level of toner. The graphic may also display a scale indicator, showing various gradations or levels, such as 100% remaining (full), 50% remaining, and 0% remaining (empty). As shown, in FIG. 3, black toner K is full and yellow toner Y is nearly half full while magenta toner M and cyan toner C are nearly empty. Alternatively, the indicator of gauge 200 may be a digital numeric display, indicating the percent of toner remaining and/or the number of days of toner supply remaining. Other forms of gauge display could include a needle gauge, such as those found in automotive gas gauges. In addition to the toner gas gauge 200, a separate out of toner warning indicator may also be provided.

Toner gas gauge 200 obtains its reading from a distinguishable usage indicator and various calibration constants. For example, in FIG. 2, this may be derived from automatic toner controller 490, which calculates drive pulses to apply to drive motor 98 to dispense a desired quantity of toner to developer 86. Disperse time accumulator 450 can accumulate the accrued drive pulses for each replenisher cycle to serve as the distinguishable usage indicator.

In an exemplary system, predicted replenisher life is calculated by comparing nominal replenisher mass ($M_{replenisher}$) with the estimated mass of toner dispensed ($M_d$), where $M_d$ may be calculated from the summation of dispense pulse time ($T_p$), which preferably includes a correction factor accounting for dispense motor start up ($T_{start\ up}$) and run on time ($T_{run\ on}$), multiplied by a nominal dispense rate ($\rho_o$) such that:

$$M_d=\rho_o(\Sigma(T_p+0.5\times(T_{run\ on}-T_{start\ up})) \quad (1)$$

The % of consumable remaining at any particular time can be calculated as:

$$\%\ \text{remaining}=(1-(M_d/M_{replienisher}))\times 100 \quad (2)$$

and displayed on gauge 200.

Nominal replenisher mass $M_{replenisher}$ is known in advance and can be stored in memory 440 within the imaging machine as a constant 460. This amount corresponds to the nominal mass of a new consumable, such as the nominal mass of toner in a new replenisher toner bottle 88. Nominal dispense rate $\rho_o$ can typically be found from experimental testing in advance for a nominal system. This value can also be stored in memory 440 with other calibration constants 460. For example, the rate can be determined by testing a full bottle of toner and running the toner dispense motor until the toner bottle is empty. From this, and an accumulation of the total dispense pulse time, it can be determined what the nominal dispense rate is per unit of dispense pulse time. Thus, by only monitoring a simple variable, such as the accumulated dispense motor pulse count stored in dispense time accumulator 450, a usage determination of consumables such as toner can be estimated. More specific estimations can be achieved by applying optional correction factor(s) that factor in foreseen deviations, such as a reduction in toner dispensing during each initial motor start up cycle ($T_{start\ up}$) and compensation for extra toner dispensing during the run on time ($T_{run\ on}$) caused by inertia acting on the motor during and after a motor pulse.

As discussed previously, this estimated indicator of consumable level is based on a nominal system, and does not have the ability to take into account any of several possible deviations from nominal operation. For example, each imaging device may deviate slightly due to various machine-to-machine variation factors, such as dispense motor performance variations from design tolerances, wear, and the like, machine voltage supply differences, frictional forces, starting replenisher mass variations, various physical component tolerances, environmental conditions such as elevation, humidity, and the like. Any of these can contribute to a certain level of deviation from nominal that will result in some degree of estimation error.

Aspects of the disclosure provide a feedback mechanism to take into account such individual system deviations and provide an adaptive correction factor for use in subsequent estimations. This reduces the effects of machine variability, and may be applied to the nominal replenisher dispense rate $\rho_0$ so that the prediction of percentage remaining will be based on a modified dispense rate $\rho'=r\rho_0$. This correction factor can be recalculated every time the toner bottle 88 becomes empty using the actual cumulative dispense time $T_d$ for that toner bottle 88 (where $T_d=(\Sigma(T_p+0.5\times(T_{run\ on}-T_{start\ up})))$, such that $\rho'=T_d/M_{replenisher}$.

Figure 4:
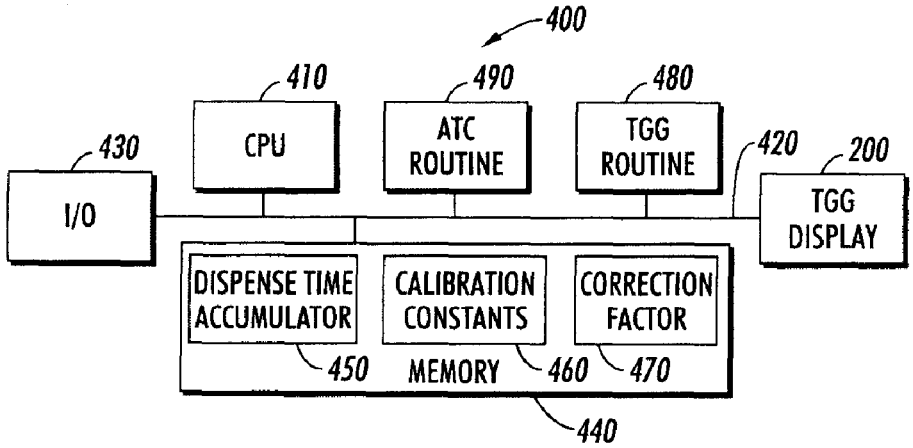
FIG. 4 illustrates an exemplary block diagram of a feedback control system for providing an adaptive toner gas gauge.

A simplified schematic showing a feedback control circuit 400 is illustrated in FIG. 4. CPU 410 is connected by bus 420 to various components, including I/O 430, memory 440 including memory addresses for dispense time accumulator 450 values generated by ATC routine 490, calibration constants 460, and a correction factor 470, and toner gas gauge display 200 driven by toner gas gauge routine 480.

Figure 5:
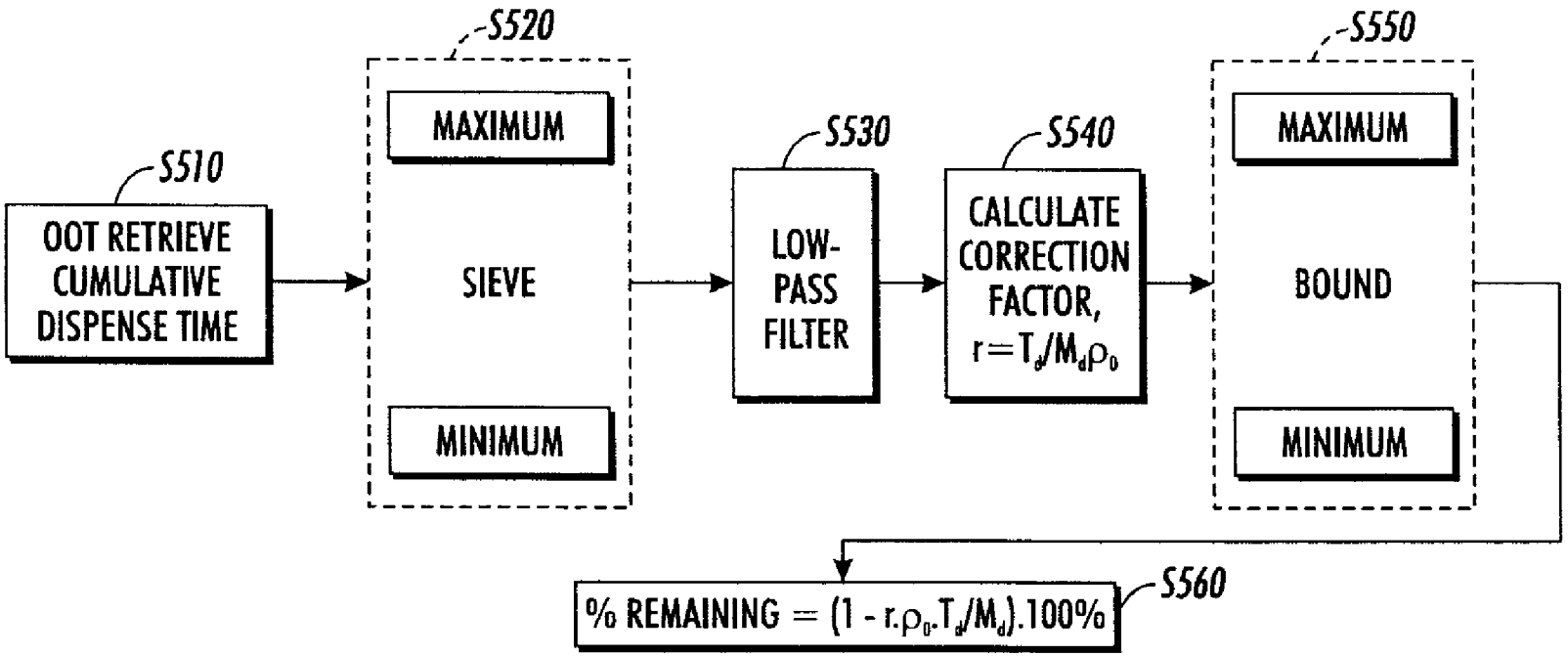
FIG. 5 illustrates a schematic of a simplified scheme for providing an adaptive correction factor for the toner gas gauge.

A simplified example of operation of feedback control circuit 400 is shown in FIG. 5. At step S510, a cumulative dispense time ($T_d$) is retrieved from dispense time accumulator 450 at the time of replacement. This cumulative time corresponds to the total dispense time for the last toner dispenser bottle at the time of replacement. In order to account for spurious correction factors due to non-nominal operating usage, such as a bottle being replaced early (well in advance of being empty) or the user installing a partially-filled toner bottle, certain embodiments at step S520 sieve any cumulative dispense times that are outside of predefined minimum and maximum boundary limits so that such values are rejected or otherwise discounted during calculation of a correction factor. Additionally, to ensure that the correction routine responds to systematic errors within the dispense process and not to the effect of statistical (random) variations, certain embodiments may also filter the dispense times using a low-pass filter at step S530. Given that a later reorder message is less desirable than an early message, the filter may respond more rapidly when the cumulative dispense time is less than a previous value, and respond less rapidly when the cumulative dispense time is greater than its previous value.

At step S540, a correction factor r is calculated. In the exemplary embodiment, $r=T_d/(Md\cdot\rho_0)$. Then, depending on the degree of correction calculated, the correction factor may be run through another bounding process at step S550 to avoid drastic correction changes by again bounding in accordance with predefined maximum and minimum correction factors. This will more slowly adapt to changing machine variations and possibly avoid cyclical variations between over and under-correction. Then, based on the correction factor, an adaptive toner gas gauge can be displayed at step S560 during operation of the machine that takes into account minor machine variances based on the last replenisher bottle cycle.

Figure 6:
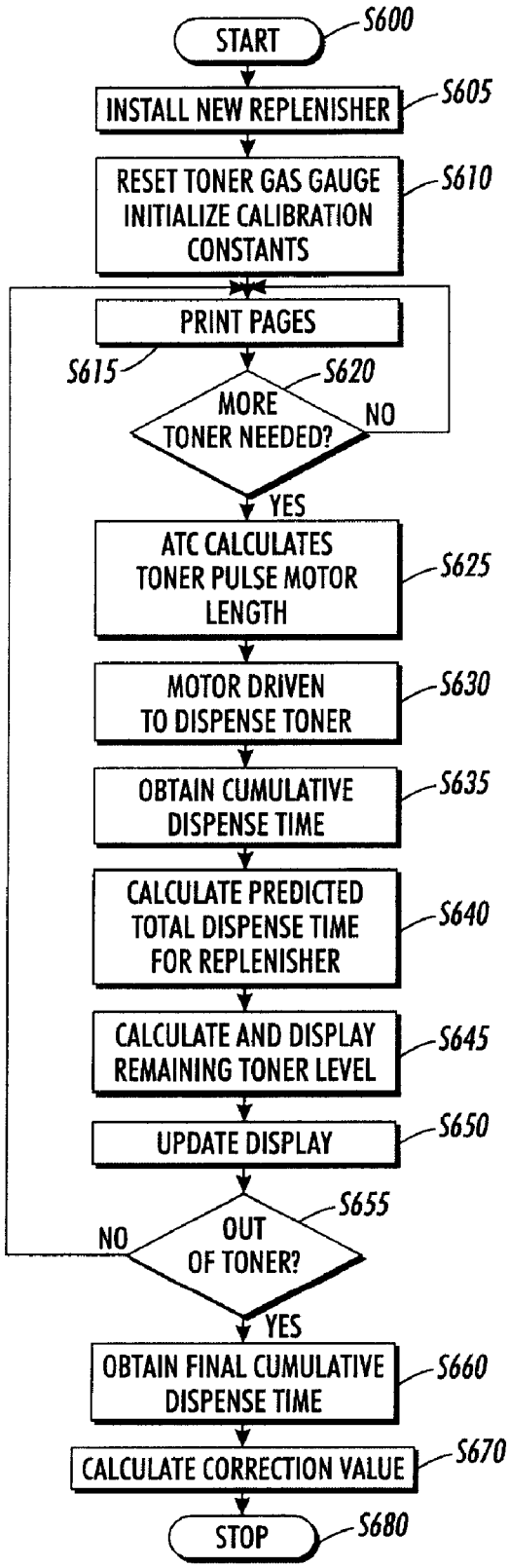
FIG. 6 illustrates a flow chart showing routine imaging machine usage monitoring and toner level estimation for a full cycle of a toner replenisher bottle.

A more detailed exemplary process for obtaining a display of remaining toner level with adaptive control will be described with reference to FIG. 6. The process starts at step S600 and proceeds to step S605 where a new replenisher bottle is installed into the imaging machine. From step S605, flow advances to step S610 where the toner gas gauge is reset and calibration constants are initialized. These can include the nominal mass of the replenisher ($M_{replenisher}$), the toner dispense rate ($\rho_0$), and an error correction factor (r). For the first replenisher, there is no correction factor. However, subsequent replenisher cycles can use a correction factor r, discussed in more detail in FIG. 7 below, that adapts to various deviations from nominal so as to provide an improved estimation of consumable usage.

Various pages are printed at step S615. After each page, the system checks at step S620 whether the machine requires more toner. If so, flow advances to step S625 where an Automatic Toner Controller (ATC) calculates the required toner dispense motor pulse length to dispense a suitable amount of toner to the dispense unit. If not, flow returns to step S615.

From step S625, flow advances to step S630 where the dispense unit drives the dispense motor by the calculated pulse length to deliver an appropriate quantity of toner into the developer. From step S630, flow advances to step S635 where a toner gas gauge routine obtains the cumulative dispense time ($T_d$). From step S635, flow advances to step S640 where the toner gas gauge routine calculates the predicted total dispense time for the current replenisher from the nominal mass of the replenisher ($M_{replenisher}$), the toner dispense rate ($\rho_0$), and an error correction factor (r).

Figure 7:
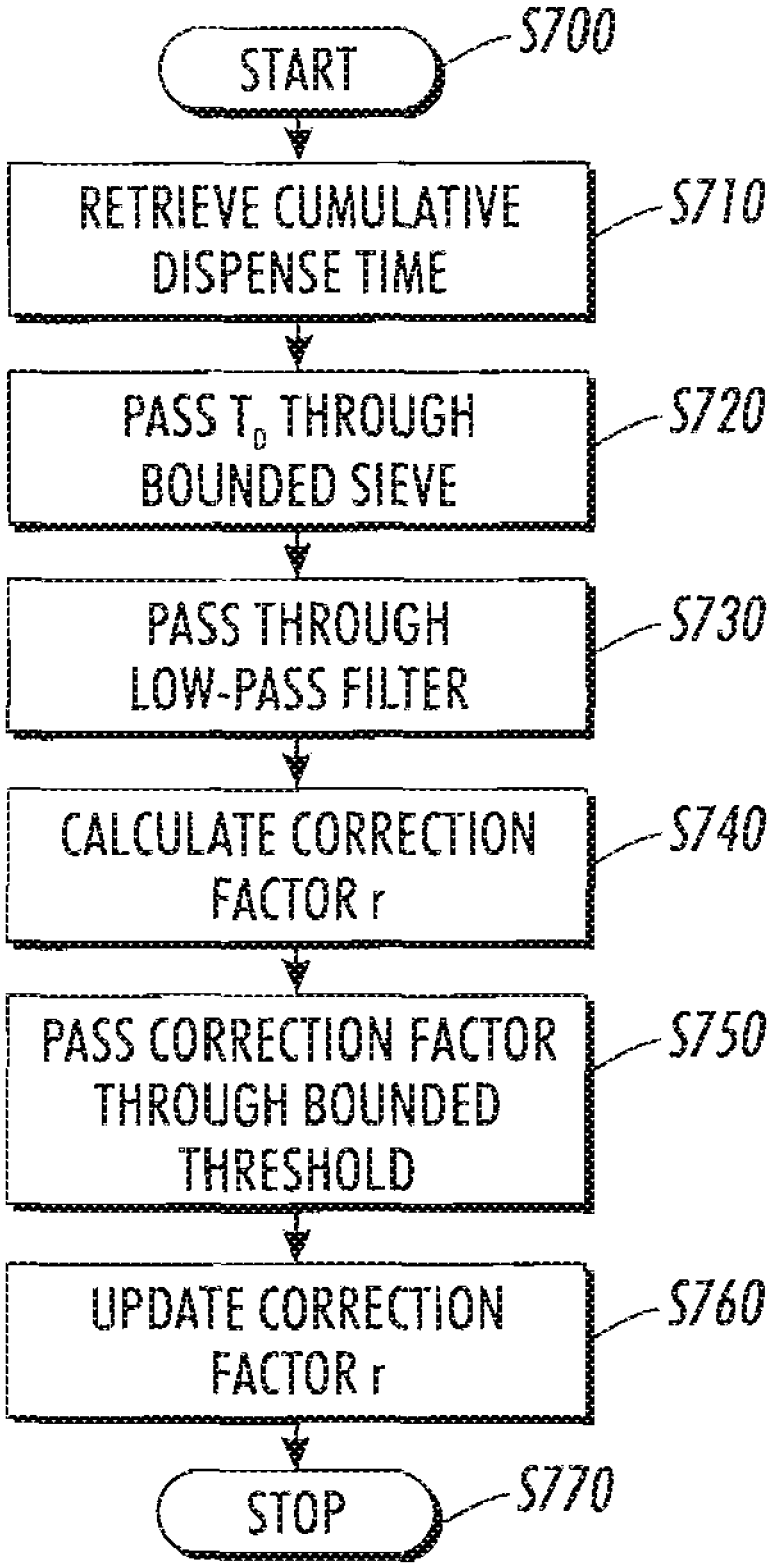
FIG. 7 illustrates a flow chart showing computation of an adaptive error correction factor to be used for subsequent toner replenisher cartridge or bottle cycles.

From step S640, flow advances to step S645 where the toner gas gauge routine calculates the % of toner remaining based on the cumulative dispense time and predicted total dispense time, and may calculate the number of days of toner remaining from an average daily usage rate. From step S645, flow advances to step S650 where the toner gas gauge display is updated. From step S650, flow advances to step S655 where it is determined whether the imaging machine is out of toner. This can be performed, for example, by level sensor 94. If not, flow returns to step S615. If so, flow advances to step S660 where a final cumulative dispense time for the complete replenisher cycle is obtained and may be stored in an address in memory 440, such as with other calibration constants 460. From step S660, flow advances to step S670 where an error correction routine described in FIG. 7 is performed. Flow stops at step S680.

An exemplary error correction routine will be described with reference to FIG. 7. The process starts at step S700 and advances to step S710 where the final cumulative dispense time is retrieved. From step S710, flow advances to step S720 where the final cumulative dispense time is passed through a bounded threshold to filter out final dispense times that are outside of predetermined nominal values and thus indicative of a spurious, non-typical result. Examples of such would be the improper insertion of a partially-filled used bottle instead of a full, new bottle. Because a partially-filled bottle will have an actual toner mass substantially less than the nominal mass assumed present in a new replenisher bottle, the total dispense time will be unusually small relative to nominal so that any correction factor based on this value would be spurious. Thus, such a condition can be excluded from relevancy in the feedback computation. Similarly, if the replenisher bottle is changed early or changed without resetting the toner gas gauge, the dispense count may also be atypical. The specific range of the bounded threshold could be based on several factors and may change for different imaging machines, or circumstances.

From step S720, flow advances to step S730 where the sieved dispense time may be further filtered through a low-pass filter. The low-pass filter may ensure that the toner gas gauge routine responds to systematic errors within the dispense process and not to the effect of statistical (random) variations. Given that a late reorder message is less desirable than an early message, the filter will respond more rapidly when the cumulative dispense time is less than its previous value and less rapidly when the cumulative dispense time is greater than its previous value.

From step S730, flow advances to step S740 where a correction factor r is calculated based on a comparison of the filtered actual cumulative dispense time and the predicted total dispense time. An exemplary calculation of r is $T_d$ $(M_{d\cdot\rho 0})$.

From step S740, flow advances to step S750 where the correction factor may be fed through another bounded threshold that may limit the maximum and minimum correction factor to be applied. This may aid in preventing cycling between over and under compensation. For example, if r is higher than the maximum threshold, correction factor r may be set to the maximum threshold amount. From step S750, flow advances to step S760 where the error correction factor is updated and stored for future toner gas gauge computation. For example, the factor can be stored as a calibration constant in step S610 of FIG. 6. The toner gas gauge routine then ends at step S770.

Memory 440 can be implemented using any appropriate combination of alterable, volatile, or non-volatile memory or non-alterable or fixed memory. The alterable memory, whether volatile or non-volatile, can be implemented using any one or more of static or dynamic RAM, a floppy disk and disk drive, a writable or rewritable optical disk and disk drive, a hard drive, flash memory or the like. Similarly, the non-alterable or fixed memory can be implemented using any one or more of ROM, PROM, EPROM, EEPROM, CD-ROM, DVD-ROM disk or the like.

Each of the various embodiments of the adaptive systems and methods of adaptive estimation of consumables level can be implemented as software executing on a programmed general purpose computer, a special purpose computer, a microprocessor or the like. It should also be understood that each of the circuits, routines, applications, objects, managers or procedures shown in FIGS. 4-7 can be implemented as portions of a suitably programmed general-purpose computer. Alternatively, each of the circuits, routines, applications, objects, managers or procedures shown in FIGS. 4-7 can be implemented as physically distinct hardware circuits within an ASIC, using a digital signal processor (DSP), using a FPGA, a PLD, a PLA and/or a PAL, or using discrete logic elements or discrete circuit elements. The particular form of the circuits, routines, applications, objects, managers or procedures shown will take is a design choice and will be obvious and predictable to those skilled in the art. It should be appreciated that the circuits, routines, applications, objects, managers or procedures shown in the FIGS. do not need to be of the same design.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. An adaptive consumables level gauge for an imaging machine, comprising:

a display that visualizes remaining levels of consumables on a gauge;

a consumables gauge circuit that receives at least one distinguishable usage indicator serving as a reference to approximate consumable dispense rate of a consumable product and estimates the level of the gauge based on the at least one distinguishable usage indicator and at least one predefined calibration constant; and a feedback control circuit that obtains a correction factor based on a cumulative usage indicator value at the time of actual consumables replacement to be used in subsequent determination of consumables level gauge estimates.

2. The adaptive consumables level gauge according to claim 1, wherein the indicator is an indirect indicator.

3. The adaptive consumables level gauge according to claim 2, wherein the consumable product is toner and the indirect indicator is a dispense motor pulse.

4. The adaptive consumables level gauge according to claim 3, wherein the estimated consumables level is a percentage of remaining consumables defined by $$\%\ \text{remaining}=(1-(r\ \rho_0 T_d/M_d)\times 100,$$

where $M_d$ is the estimated mass of consumables dispensed and is equal to $\rho_o(\Sigma(T_p))$, $\rho_o$ is a predetermined nominal dispense rate, $T_p$ is a dispense pulse time, $T_d$ is total cumulative dispense pulse time, and r is the correction factor.

5. The adaptive consumables level gauge according to claim 1, wherein the at least one predefined calibration constant includes one or more of the group of nominal consumable mass and nominal dispense rate.

6. The adaptive consumables level gauge according to claim 1, wherein the feedback control circuit includes a bounding threshold that discounts an atypical cumulative value that fall outside of a predefined bounded range.

7. The adaptive consumables level gauge according to claim 1, wherein the feedback control circuit includes a low-pass filter.

8. The adaptive consumables level gauge according to claim 7, wherein the low-pass filter is a non-linear filter.

9. The adaptive consumables level gauge according to claim 1, wherein the feedback control circuit includes a bounding threshold that discounts correction factors that fall outside of a predefined bounded range.

10. A method for adapting an estimation of a consumables level gauge for an imaging machine to reflect usage during a prior consumables cycle, comprising:

retrieving a final cumulative usage indicator value at the time of replacement of a consumable product replacement;

passing the final cumulative usage indicator value through a bounded threshold that discounts an atypical cumulative value that falls outside of a predefined bounded range; and calculating a correction factor r to be used in subsequent consumables level gauge estimation that is based on the final cumulative usage indication.

11. The method according to claim 10, further comprising passing the final cumulative usage indicator value through a low-pass filter prior to calculation of the correction factor r.

12. The method according to claim 11, wherein the low-pass filter is a non-linear filter.

13. The method according to claim 10, further comprising passing the correction factor r through a bounded threshold to discount any correction factor that falls outside of a predefined bounded range.

14. The method according to claim 10, wherein the correction factor $r=T_d/(M_d\cdot\rho_0)$, where $M_d$ is the estimated mass of consumables dispensed and is equal to $\rho_o(\Sigma(T_p))$, $\rho_o$ is a predetermined nominal dispense rate, $T_p$ is a dispense pulse time, $T_d$ is total cumulative dispense pulse time, and r is the correction factor.

15. A method for adaptive display of a consumables gauge on an imaging machine, comprising:

initializing calibration constants upon installation of a new consumable product in the machine;

obtaining at least one distinguishable usage indicator serving as a reference to approximate consumable dispense rate of the consumable product;

estimating the level of the gauge based on a total accumulation of the at least one distinguishable usage indicator and at least one predefined calibration constant;

displaying the estimated consumable level on the gauge;

obtaining a final cumulative distinguishable usage indicator value at time of replacement of the consumable product; and calculating a correction factor r to be used in subsequent estimation of consumable level on the gauge based on the final cumulative distinguishing usage indicator value.

16. The method according to claim 15, wherein the consumable is toner.

17. The method according to claim 15, wherein the indicator is an indirect indicator.

18. The method according to claim 17, wherein the indicator is a dispense motor pulse.

19. The method according to claim 18, wherein the estimated consumables level is a percentage of remaining consumables defined by $$\%\ \text{remaining}=(1-(r\ \rho_o T_d/M_c d)\times 100,$$

where $M_d$ is the estimated mass of consumables dispensed and is equal to $\rho_o(\Sigma(T_p))$, $\rho_o$ is a predetermined nominal dispense rate, $T_p$ is a dispense pulse time, $T_d$ is total cumulative dispense pulse time, and r is the correction factor.

20. The method according to claim 15, wherein at least one predefined calibration constant includes one or more of the group of nominal consumable mass and nominal dispense rate.

* * * * *